US005330402A

United States Patent [19]

Johnson

[11] Patent Number: 5,330,402

[45] Date of Patent: Jul. 19, 1994

[54] EXERCISING DEVICE

[76] Inventor: Kimball W. Johnson, P.O. Box 126, Orleans, Vt. 05860

[21] Appl. No.: 59,859

[22] Filed: May 11, 1993

[51] Int. Cl.[5] ..... A63B 22/12; A63B 22/04

[52] U.S. Cl. ..... 482/62; 482/52

[58] Field of Search ..... 482/62, 56, 79, 52, 482/53

[56] References Cited

U.S. PATENT DOCUMENTS

| | | | |
|---|---|---|---|
| 1,820,372 | 8/1931 | Blomquist | 482/62 |
| 3,213,852 | 10/1965 | Zent . | |
| 3,731,921 | 5/1973 | Andrews | 482/56 |
| 3,964,742 | 6/1976 | Carnielli . | |
| 4,423,863 | 1/1984 | Figueroa . | |
| 4,436,097 | 3/1984 | Cunningham . | |
| 5,044,627 | 9/1991 | Huang . | |

FOREIGN PATENT DOCUMENTS

| | | | |
|---|---|---|---|
| 2558064 | 7/1985 | France | 482/62 |
| 8903237 | 4/1989 | PCT Int'l Appl. | 482/79 |
| 1248616 | 8/1986 | U.S.S.R. | 482/62 |

*Primary Examiner*—Stephen R. Crow
*Attorney, Agent, or Firm*—Brady, O'Boyle & Gates

[57] ABSTRACT

An exercising device wherein a rotary crank handle mechanism is mounted on the upper end portion of a frame assembly for exercising the upper body portion of a person, and an exercising mechanism is mounted on the lower portion of the frame assembly for exercising the lower body portion of the person. The upper and lower exercising mechanisms are independently operable from each other, and the upper crank handle mechanism is provided with a plurality of adjustment features so that the mechanism can be pivoted to a desired position relative to the frame assembly and the crank arms can be oriented relative to each other to recreate the effects of swimming or rowing.

12 Claims, 8 Drawing Sheets

EXERCISING DEVICE

BACKGROUND OF THE INVENTION

Various bicycle-type exercising devices have been proposed having a lower rotary crank pedal mechanism, whereby the user can exercise his or her lower body, and an upper rotary crank handle mechanism for exercising the upper body.

These types of exercising devices are disclosed in U.S. Pat. Nos. 3,213,852; 3,964,742; and 4,436,097, wherein the upper rotary crank handle mechanism and lower rotary crank pedal mechanism are interconnected by sprocket chains and gears, thereby precluding the user from choosing the speed or level of resistance in either the upper or lower rotary mechanism.

U.S. Pat. Nos. 4,423,863 and 5,044,627 disclose bicycle-type exercising devices wherein the upper rotary crank handle mechanism is independent from the lower rotary crank pedal mechanism.

While the prior art bicycle-type exercising devices have been satisfactory for their intended purpose, by the construction and arrangement of their rotary crank handle mechanism, the user's exercise of the upper body was limited, as it was necessary for the user to be seated on the device during the workout.

After considerable research and experimentation, the exercising device of the present invention has been devised wherein the rotary crank handle mechanism is adjustable to various positions, whereby the user's exercise of the upper body cannot only recreate the effects of swimming but also rowing, and a user can exercise the upper body without being seated on the device.

SUMMARY OF THE INVENTION

The exercising device of the present invention comprises, essentially, a bicycle-type frame assembly having a saddle seat, a lower rotary crank pedal mechanism, and an upper rotary crank handle mechanism. The upper and lower crank mechanisms are independent of each other so that the user can set independent upper and lower resistance settings to accommodate the most comfortable workout for the user.

The upper rotary crank handle mechanism is adjustably mounted on the frame assembly to be moved both vertically and horizontally to accommodate the particular size of the user seated on the frame assembly. The crank handle mechanism is also pivotally mounted on the frame assembly so that a user can stand on the lower rotary pedal mechanism while simultaneously using the upper rotary crank handle mechanism, and the crank handle mechanism can be pivoted to a position in front of the frame assembly so that a person sitting in a chair or bed can use the rotary crank handle mechanism for exercising the upper body. The handles in the crank mechanism are also adjustable relative to each other so that the user can simulate the motions of swimming or rowing.

DESCRIPTION OF THE PREFERRED EMBODIMENTS

Figure 1:
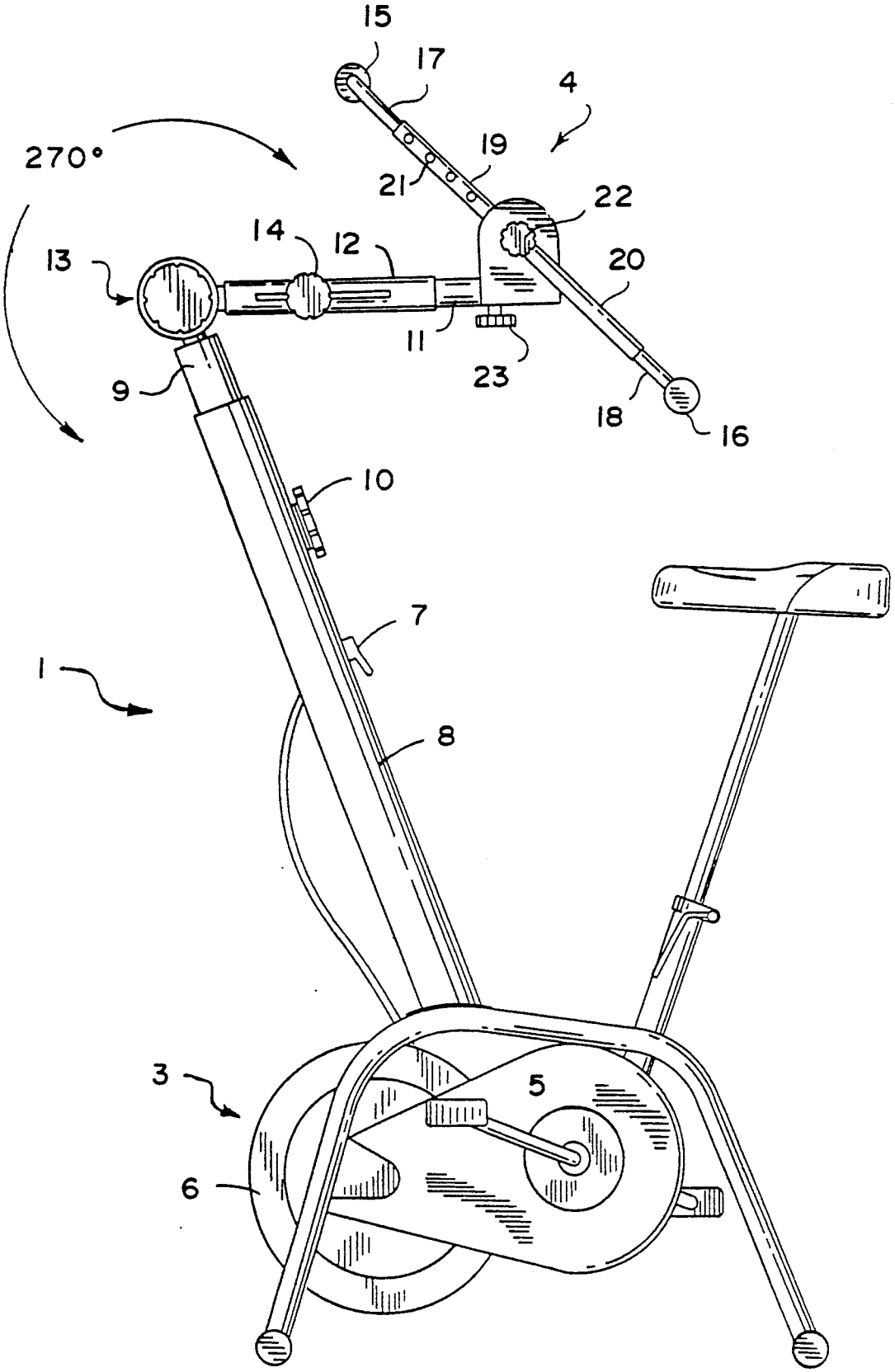
FIG. 1 is a side elevational view of the exercise device of the present invention.

Referring to the drawings and more particularly to FIG. 1, the exercising device of the present invention comprises a stationary bicycle-type tubular frame assembly 1 having a saddle seat 2, a lower rotary crank pedal mechanism 3 and an upper rotary crank handle mechanism 4.

The lower rotary crank pedal mechanism 3 includes the conventional pedal crank 5 operatively connected to a flywheel 6 and having a tension or resistance control 7 mounted on the frame member 8. Another frame member 9 is telescopically received in the upper end of frame member 8 and is held in a desired extended position by a threaded locking knob 10.

The upper rotary crank handle mechanism 4 is mounted on one end of an arm 11 telescopically received in one end of another arm 12, the other end of arm 12 being secured to a pivot connection 13 which is mounted on the upper end of frame member 9, whereby the upper rotary crank arm mechanism 4 can be pivoted relative to the tubular frame assembly 1, through an arc of 270°. A threaded lock knob 14 extends through the telescopic arms 12 and 11 for holding the arm 11 in a desired extended position.

Figure 6:
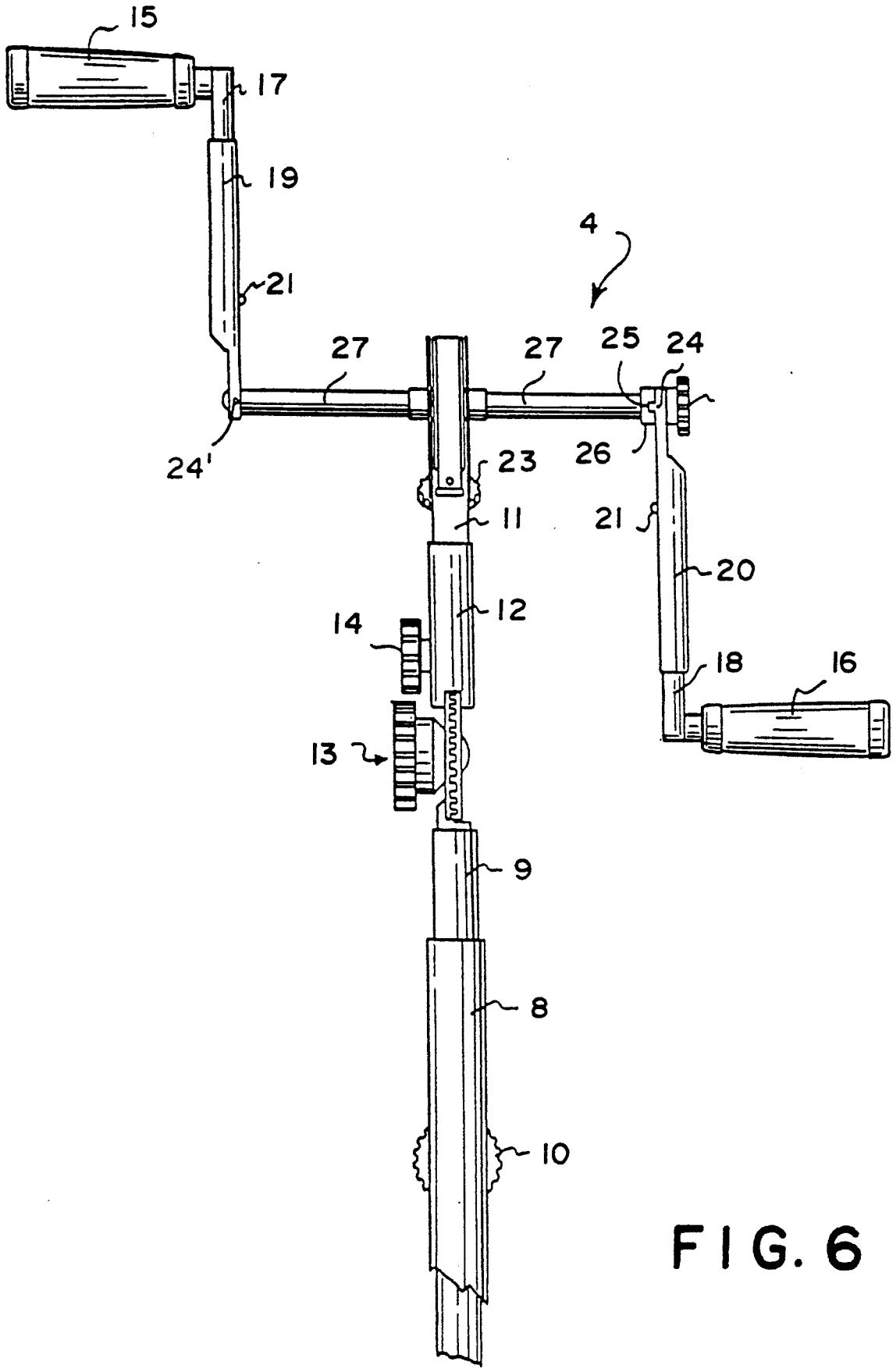
FIG. 6 is a fragmentary front elevational view of the upper crank handle mechanism wherein the handles are oriented to a position where the user can recreate the effects of swimming.
Figure 7:
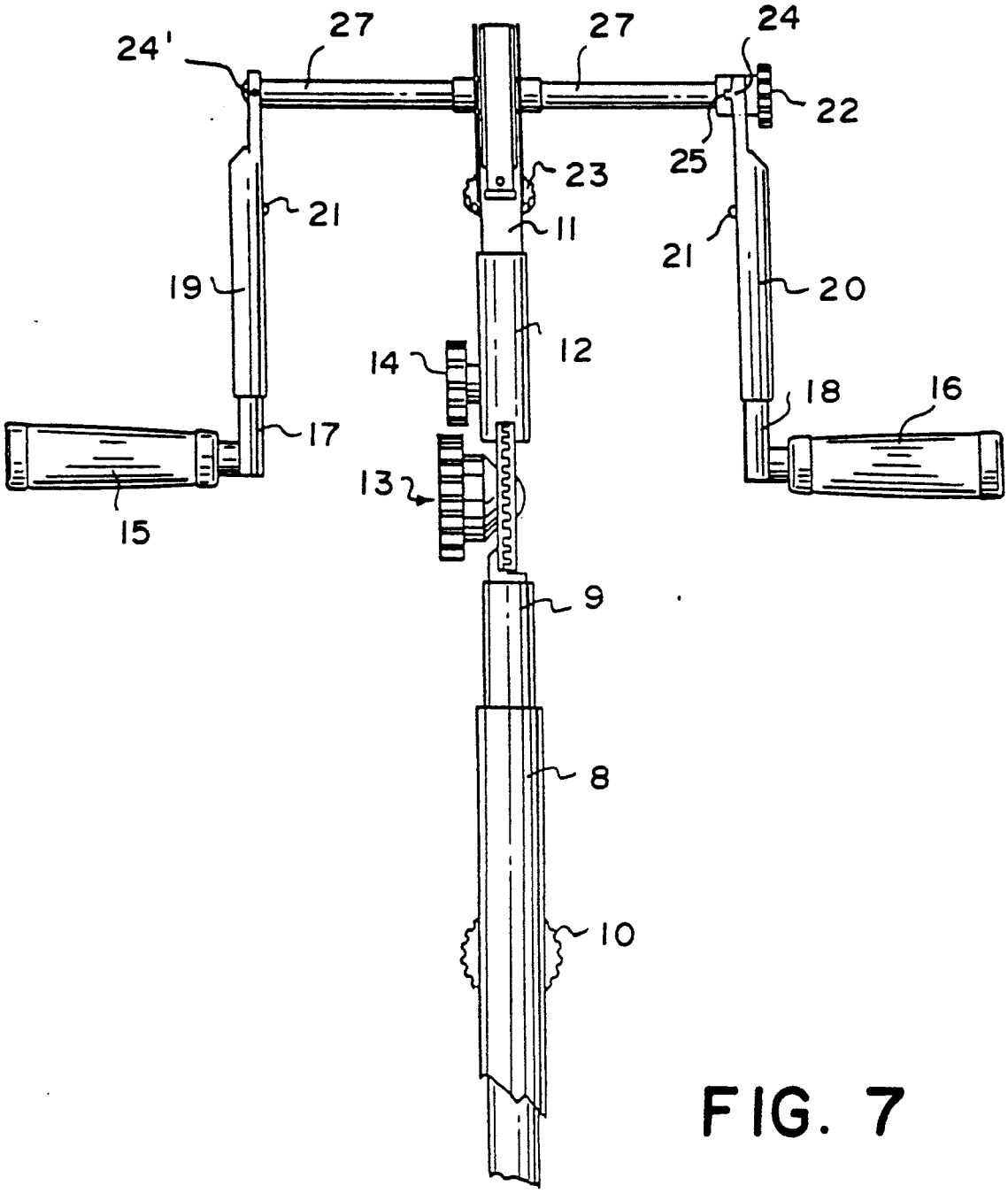
FIG. 7 is a fragmentary front elevational view of the upper crank handle mechanism wherein the handles are oriented to a position where the user can recreate the effects of rowing.

The upper rotary crank arm mechanism 4 includes a pair of hand grips 15 and 16 journaled on the ends of arm members 17 and 18 telescopically received within crank arms 19 and 20 for holding the arm members 17 and 18 in a desired extended position. A locking knob 22 is provided on the end of the crank arm 20, whereby crank arm 20 can be set at a directly opposed position to crank arm 19, as shown in FIGS. 1 and 6, or in a parallel position as shown in FIG. 7.

The upper rotary crank handle assembly 4 is also provided with a tension knob 23 for adjusting the resistance of the crank handle assembly.

Figure 2:
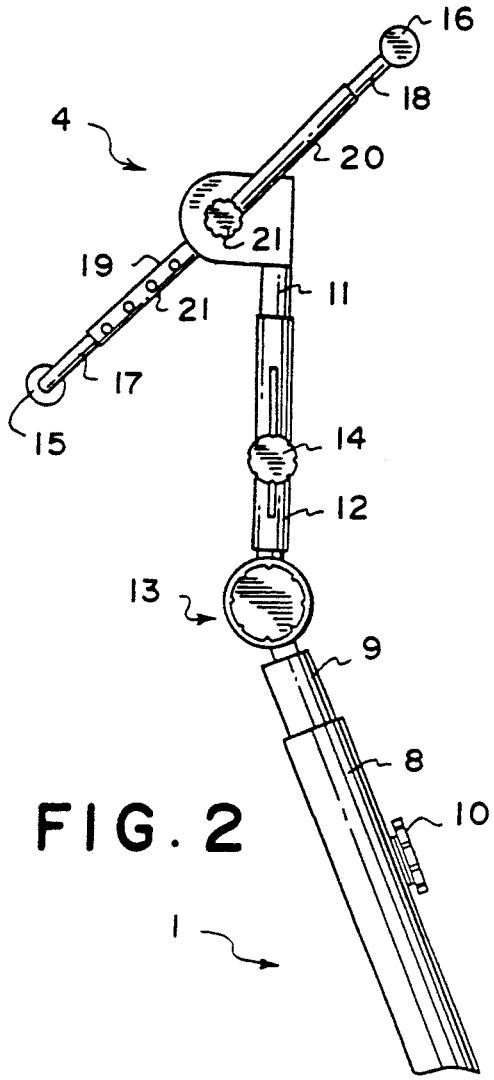
FIG. 2 is a fragmentary side elevational view showing the upper crank handle mechanism pivoted to a position upwardly from that of FIG. 1.
Figure 3:
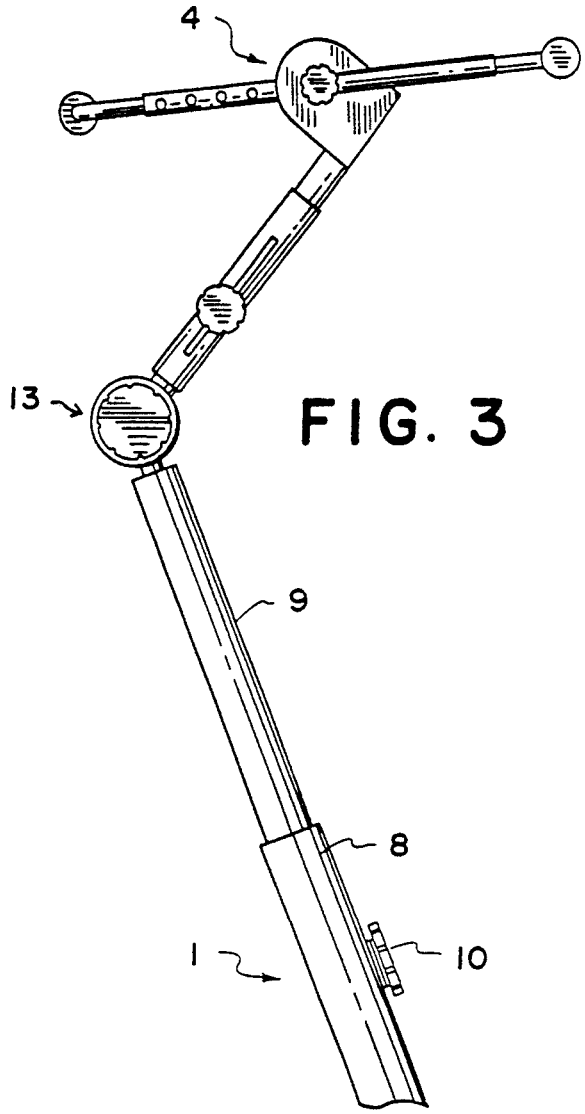
FIG. 3 is a fragmentary side elevational view showing the upper crank handle mechanism extended vertically from the position shown in FIG. 1 and pivoted to another position.
Figure 4:
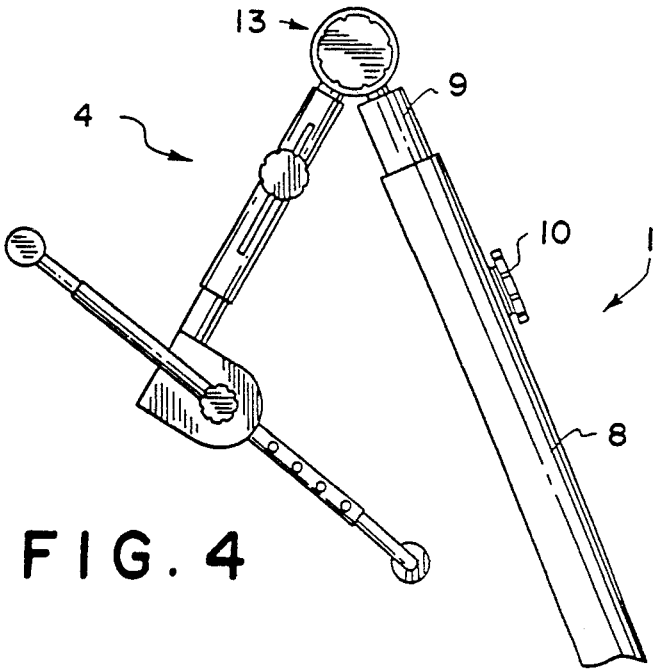
FIG. 4 is a fragmentary side elevational view showing the upper crank handle mechanism pivoted to a position in front of the frame assembly.

FIGS. 2, 3 and 4 illustrate the various positions to which the upper rotary crank arm mechanism 4 can be adjusted to accommodate a particular person, either seated or standing on the exerciser, or positioned in front of the exerciser.

Figure 5:
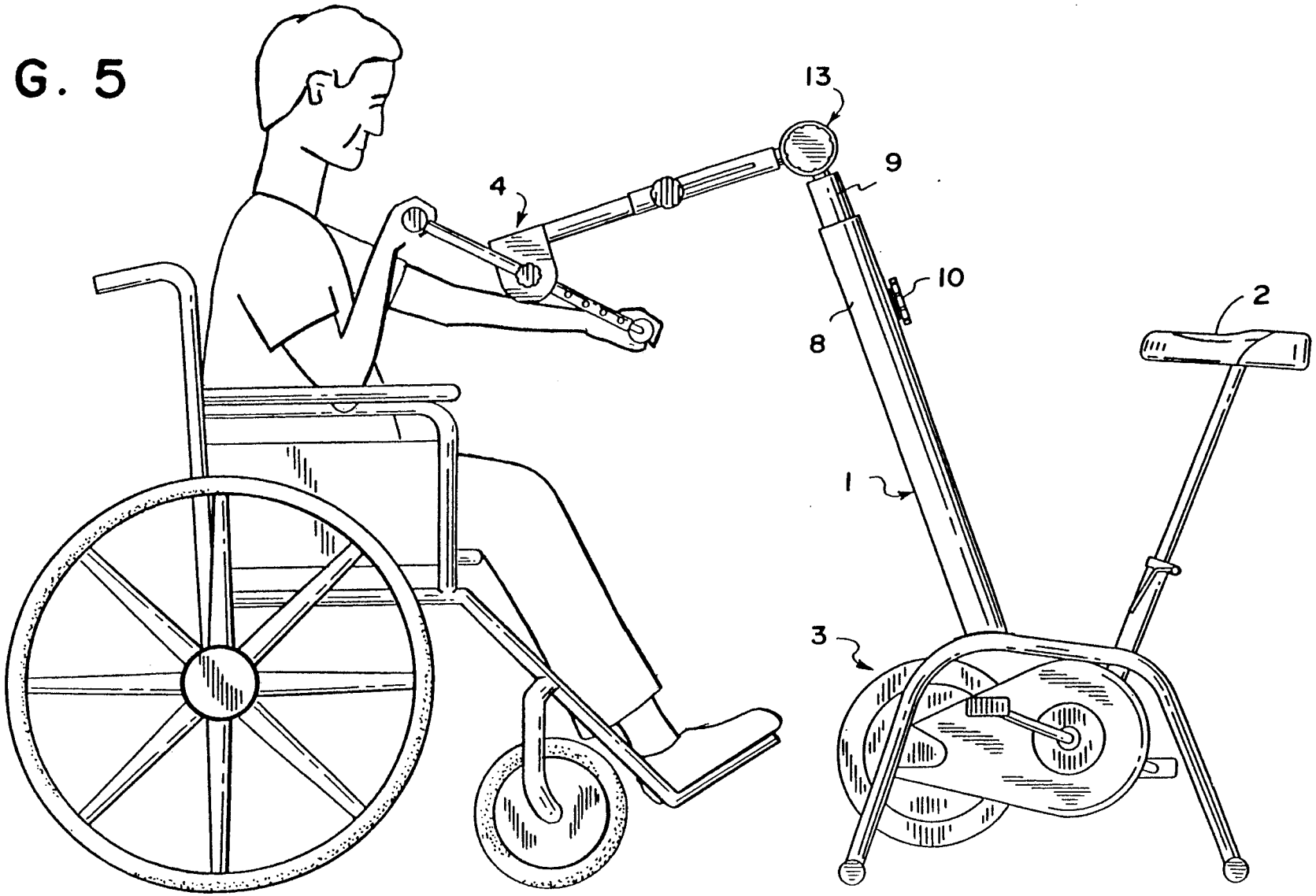
FIG. 5 is a side elevational view of the exercise device having the upper rotary crank handle mechanism pivoted to a position in front of the frame assembly to accommodate the exerciser to a person seated in a wheelchair.

FIG. 5 illustrates the adjusted position of the upper rotary crank arm assembly 4 for use by a person seated in a wheelchair.

FIGS. 6 and 7 illustrate the construction of the connection of the crank arms 19 and 20 whereby crank arm 20 can be set at a directly opposed position relative to crank arm 19 (FIG. 6) or in a parallel position (FIG. 7). The inner end portion of crank arm 20 is provided with keys 24 adapted to be received in correspondingly-shaped slots 25 formed in the face of a collar 26 fixed to the outer end of a rotary shaft 27. To hold crank arm 20 in the desired position, the locking knob 22 is threaded into the end of the rotary shaft 27 and, when tightened, the keys 24 are forced into engagement with the slot 25. The crank arm 19 is fixedly secured to the shaft 27 by a pin 24' extending through the inner end portion of the crank arm 19 and into the shaft 27.

Figure 8:
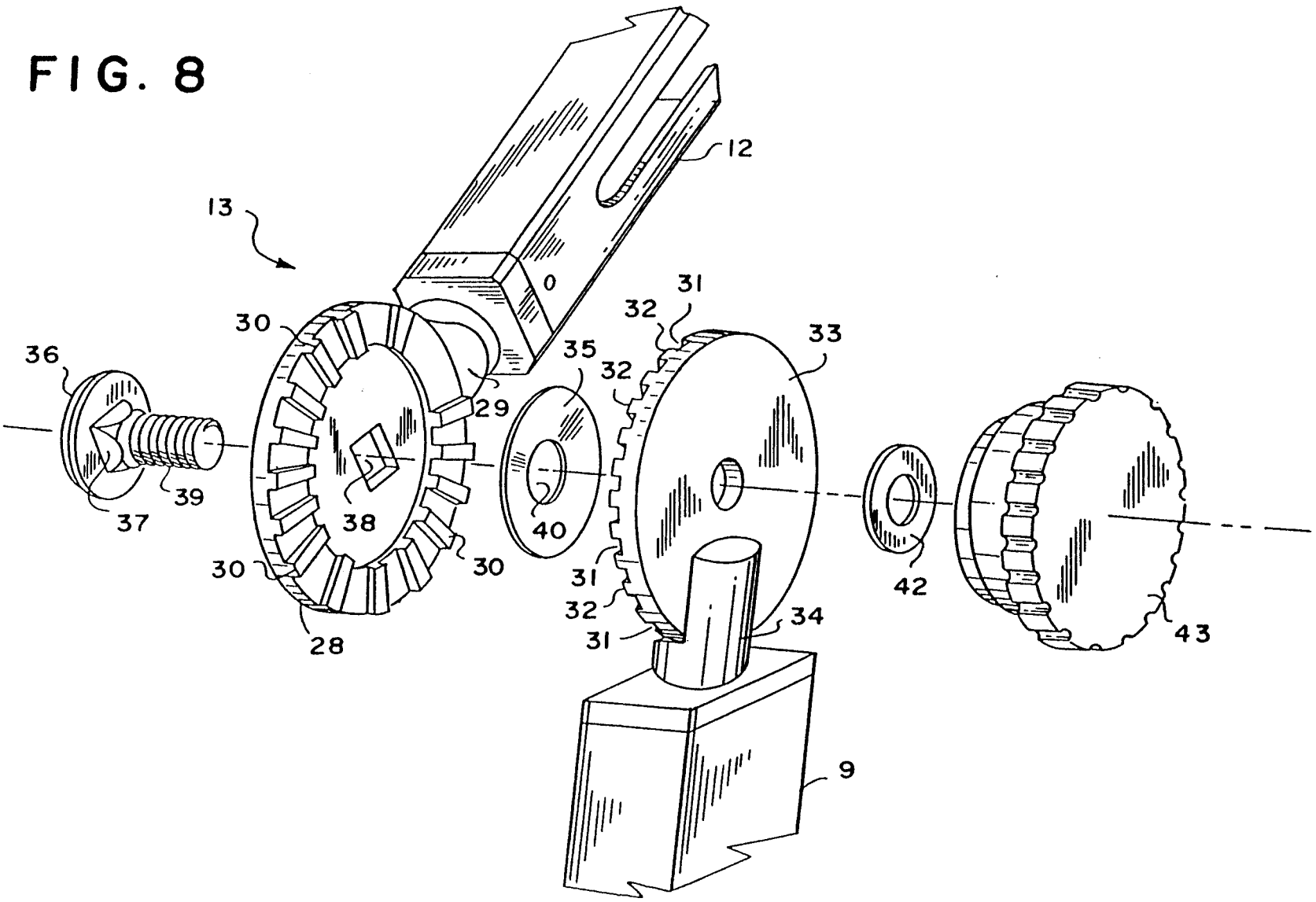
FIG. 8 is an enlarged, exploded view of the pivotal connection of the upper rotary crank handle mechanism to the frame assembly.

The details of the construction of the pivotal connection 13 are illustrated in FIG. 8 wherein it will be seen that a disc 28 is fixedly connected to the end of arm 12 by a stem 29. A plurality of annularly spaced teeth 30 are provided in the face of the disc 28 and are selectively receivable in the spaces 31 between annularly spaced teeth 32 provided in the face of another disc 33 fixedly connected to the end of frame member 9 by a stem 34. A Bellville spring 35 is interposed the discs 28 and 33 urging the discs in a direction out of engagement with each other. To hold the discs 28 and 33 in a desired angular relationship, a bolt 36 is provided having a rectangular base portion 37 which is insertable into a rectangular opening 38 in the center of disc 28, the threaded stem 39 of the bolt being insertable through central holes 40, 41 provided in the Bellville spring 35 and disc 33, respectively. The bolt stem 39 also extends through a washer 42 positioned between the outer face of the disc 33 and the inner face of a lock knob 43 which is threaded onto the bolt stem 39.

By this construction and arrangement, when it is desired to adjust the position of the upper crank arm assembly 4 through an arc of 270° as shown in FIGS. 1 to 5, the knob 43 is loosened so that the spring 35 spreads the toothed discs 28 and 31 out of engagement whereby the upper crank arm assembly 4 becomes freely pivotal relative to the frame member 9. When the desired position is obtained, the knob is tightened to force the toothed discs 28 into interdigital engagement.

Figure 9:
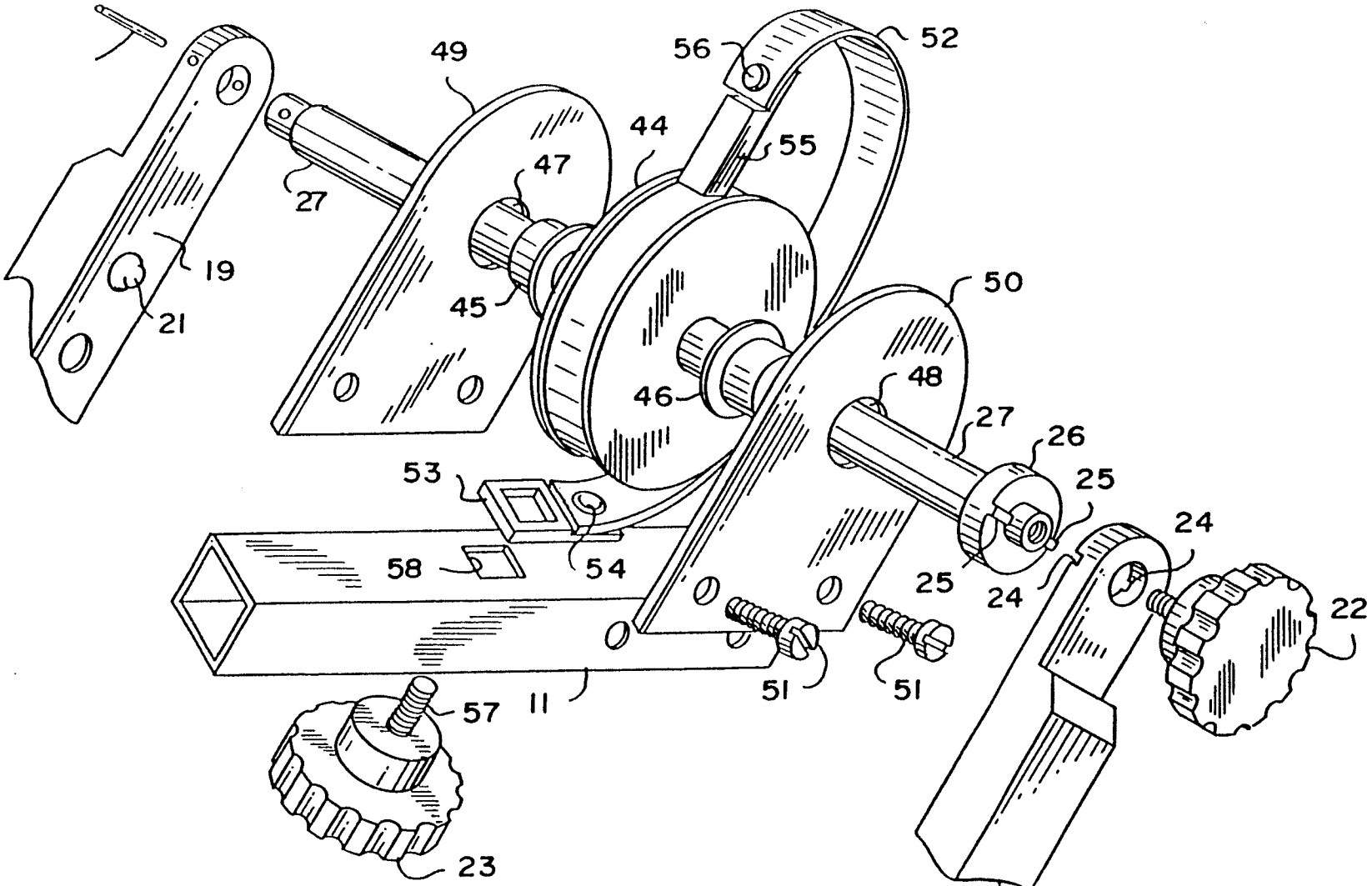
FIG. 9 is an enlarged, exploded view of the tension mechanism for varying the resistance of the upper rotary crank arm mechanism.

FIG. 9 illustrates the details of the construction of the tension or resistance mechanism for the crank arms 19 and 20, and comprises a pulley 44 secured to the rotary shaft 27. A pair of bushings 45 and 46 are mounted on the shaft 27 on each side of the pulley 44 and journaled in openings 47 and 48 provided in side plates 49 and 50 secured to the arm 11 by suitable bolts 51. A suitable strap 52 extends around the peripheral portion of the pulley 44, and has an apertured plate 53 fixedly secured at one end thereof as at 56. The tension knob 23 has a threaded bolt 57 adapted to extend upwardly through the bottom wall of arm 11, the top wall of which is provided with a rectangular opening 58 over which the apertured plate 53 extends, and through which the nut 55 extends, the bolt 57 being threaded into the nut 55. By this construction and arrangement, when the tension knob 23 is turned in a direction to tighten the nut 55 and bolt 57, the strap 52 is drawn inwardly against the peripheral surface of the pulley 44 to increase the resistance to rotation of the shaft 27 by the crank arms 19 and 20.

Figure 10:
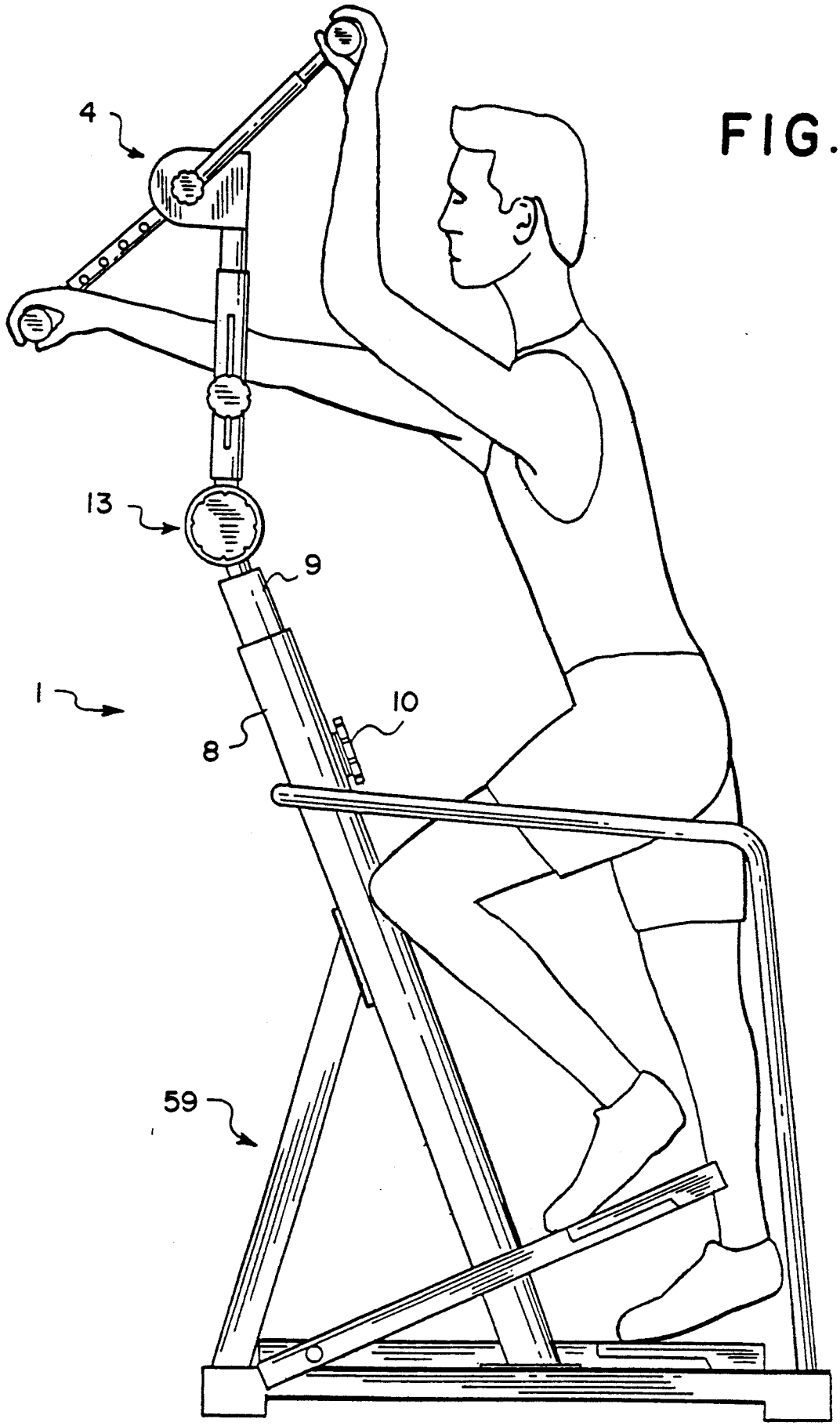
FIG. 10 is a side elevational view of another embodiment of the invention wherein the upper rotary crank handle mechanism is mounted on a frame having a stepper mechanism in lieu of the lower rotary crank pedal mechanism shown in FIGS. 1 and 5.

While the upper rotary crank handle mechanism 4 has been described with a bicycle-type lower rotary crank pedal mechanism 3, as shown in FIGS. 1 and 5, FIG. 10 discloses the use of the upper rotary crank handle mechanism 4 mounted on telescopic frame members 8 and 9 which are connected to a stepper assembly 59.

From the above description, it will be appreciated by those skilled in the art that the exercise device of the present invention provides the user with a full body, cardiovascular workout by the active exercising of both the upper and lower body. It is designed to allow the older, less coordinated person the chance to achieve a full body workout without having to stand for extended periods of time or perform exercises which demand a certain level of body coordination to be effective.

The adjustability of the tubular frame members 8, 9, arms 11, 12, pivot connection 13, and crank arms 19 and 20 allows the user to define the specific type of exercise needed among the many exercises the device can provide, and the device can be adjusted to accommodate people of different sizes and types.

A further advantage of the exercise device of the present invention is that it can be used in either a home or in a rehabilitation hospital setting, since the device is simple, portable, adjustable and lightweight in construction, and is readily adjustable to either a patient or to different positions and body attitude in exercising.

It is to be understood that the form of the invention herewith shown and described is to be taken as a preferred example of the same, and that various changes in the shape, size and arrangement of parts may be resorted to, without departing from the spirit of the invention or scope of the subjoined claims.

I claim:

1. An exercising device comprising frame means having an upper portion and a lower portion a rotary crank handle mechanism mounted on the upper portion of said frame means for exercising the upper body portion of a person, an exercising mechanism mounted on the lower portion of said frame means for exercising the lower body portion of a person, the upper rotary crank handle mechanism and the lower exercising mechanism being independently operable from each other, adjustable pivot means for connecting the rotary crank handle mechanism to the upper portion of the frame means for pivoting the rotary crank handle mechanism in a vertical plane through an arc at least 270°, whereby the angular orientation of the rotary crank handle relative to the frame means can be pivotally adjusted from a position in proximity to a user on one side of said frame means distal to the user through an arc of at least 270° to the other side of said frame means to thereby selectively position the rotary crank handle mechanism for use by a person on either side of said pivot means for exercising the upper body.

2. An exercising device according to claim 1, wherein an adjustment means is connected to the frame means, whereby the height of the frame means can be varied.

3. An exercising device according to claim 1, wherein the rotary crank handle mechanism comprises arm means having one end connected to said pivot means, a rotary shaft mounted on the other end of said arm means, and crank handle means mounted on each end of said rotary shaft.

4. An exercising device according to claim 3, wherein the arm means comprises a pair of adjustable telescopic arm members, whereby the distance between the rotary crank handle mechanism and the pivot means can be varied.

5. An exercising device according to claim 2, wherein the crank handle means comprises, a pair of crank arms, one end of each crank arm being connected to a respective end of the rotary shaft, a hand grip operably connected to the opposite end of each crank arm, and adjustment means connecting at least one crank arm to the end of the rotary shaft whereby the hand grips on each crank arm can be adjusted relative to each other to recreate the effects of swimming or rowing.

6. An exercising device according to claim 5, wherein the adjustment means comprises, a collar fixedly mounted on an end portion of said shaft, keys provided on the face of said one end of a crank arm, said keys being received in correspondingly shaped slots provided in the opposite face of said collar, and a locking knob threaded into the end of said shaft for holding the crank arm keys in the collar slots.

7. An exercising device according to claim 3, wherein a tension mechanism is mounted on the rotary shaft whereby the resistance to the rotary movement of the crank handle mechanism can be varied.

8. An exercising device according to claim 7, wherein the tension mechanism comprises, a pulley mounted on the rotary shaft intermediate the ends thereof, a strap extending around the peripheral portion of said pulley, one end of said strap being fixedly connected to said other end of said arm means, a nut fixedly connected to the other end of said strap, a tension knob having a threaded bolt mounted on said other end of said arm means, said bolt being threaded into said nut, whereby upon tightening the tension knob the strap is caused to frictionally engage the peripheral surface of the pulley, to thereby increase the resistance to rotary motion of the crank arms.

9. An exercising device according to claim 3, wherein the pivot means comprises a disc fixedly connected to said one end of the arm means, another disc being fixedly connected to the upper end portion of said frame means, said discs being positioned in face-to-face relationship, a plurality of circumferentially spaced teeth provided in the face of each disc, the teeth in one disc being selectively receivable in the spaces between the teeth in the other disc, and a bolt and lock knob assembly connected to said discs for holding the discs in the selected angular orientation.

10. An exercising device according to claim 1, wherein the exercising mechanism mounted on the lower portion of the frame means comprises a bicycle-type rotary crank pedal mechanism.

11. An exercising device according to claim 1, wherein the exercising mechanism mounted on the lower portion of the frame means comprises a stepper assembly.

12. An exercising device according to claim 1, wherein the frame means includes a frame member telescopically mounted within a tubular frame member, and a threaded locking knob connected between the frame member for holding the inner frame member at a desired extended position relative to the tubular frame member.

* * * * *